US010093326B2

(12) United States Patent
Glinka et al.

(10) Patent No.: US 10,093,326 B2
(45) Date of Patent: Oct. 9, 2018

(54) ASSEMBLY HAVING AN UNDERCARRIAGE UNIT

(71) Applicant: SIEMENS AKTIENGESELLSCHAFT, Munich (DE)

(72) Inventors: Martin Glinka, Uttenreuth (DE); Thorsten Stuetzle, Nuremberg (DE); Martin Teichmann, Graz (AT)

(73) Assignee: Siemens Aktiengesellschaft, Munich (DE)

( * ) Notice: Subject to any disclaimer, the term of this patent is extended or adjusted under 35 U.S.C. 154(b) by 189 days.

(21) Appl. No.: 15/103,659

(22) PCT Filed: Dec. 10, 2014

(86) PCT No.: PCT/EP2014/077189
§ 371 (c)(1),
(2) Date: Jun. 10, 2016

(87) PCT Pub. No.: WO2015/086667
PCT Pub. Date: Jun. 18, 2015

(65) Prior Publication Data

US 2016/0318527 A1 Nov. 3, 2016

(30) Foreign Application Priority Data

Dec. 13, 2013 (DE) ..... 10 2013 225 913

(51) Int. Cl.
*B61F 3/04* (2006.01)
*B61C 9/50* (2006.01)
(Continued)

(52) U.S. Cl.
CPC ..... *B61F 3/04* (2013.01); *B61C 3/00* (2013.01); *B61C 3/02* (2013.01); *B61C 9/50* (2013.01);
(Continued)

(58) Field of Classification Search
CPC ... B61F 3/125; B61F 5/50; B61K 9/02; B61L 27/04; B61C 3/00; B61C 3/02; B61C 9/50
See application file for complete search history.

(56) References Cited

U.S. PATENT DOCUMENTS

2013/0220718 A1* 8/2013 Gotou ..... B60K 1/00 180/65.6
2016/0082986 A1* 3/2016 Kreuzweger ..... B61F 5/24 105/218.1
(Continued)

FOREIGN PATENT DOCUMENTS

CN 102501858 A 6/2012
CN 203094062 U 7/2013
(Continued)

*Primary Examiner* — Jason C Smith
(74) *Attorney, Agent, or Firm* — Laurence Greenberg; Werner Stemer; Ralph Locher

(57) ABSTRACT

An assembly for a vehicle, in particular a rail vehicle, includes an undercarriage unit having at least one first wheel set supported on a track and a main body supported on the first wheel set. The main body has a coupling mechanism for mechanically coupling to at least one car body of the vehicle. At least one first driving motor for driving the first wheel set, at least one power supply unit for supplying the driving motor with electrical power and at least one inverter unit are provided. The power supply unit is disposed at least partially in a region of the undercarriage unit in order to permit the undercarriage unit of the assembly to be expanded with regard to the functionalities of the undercarriage unit.

12 Claims, 7 Drawing Sheets

(51) Int. Cl.

| | |
|---|---|
| ***B61F 3/12*** | (2006.01) |
| ***B61C 3/00*** | (2006.01) |
| ***B61C 3/02*** | (2006.01) |
| ***B61F 5/50*** | (2006.01) |
| ***B61K 9/02*** | (2006.01) |
| ***B61L 27/04*** | (2006.01) |

(52) U.S. Cl.
CPC ..... *B61F 3/125* (2013.01); *B61F 5/50* (2013.01); *B61K 9/02* (2013.01); *B61L 27/04* (2013.01)

(56) References Cited

U.S. PATENT DOCUMENTS

| | | | | |
|---|---|---|---|---|
| 2016/0167681 | A1* | 6/2016 | Rodet | B61F 3/00 105/139 |
| 2016/0214628 | A1* | 7/2016 | Bieker | B61F 5/50 |
| 2016/0318527 | A1* | 11/2016 | Glinka | B61C 9/50 |
| 2017/0101114 | A1* | 4/2017 | Chen | B61F 5/30 |

FOREIGN PATENT DOCUMENTS

| | | | |
|---|---|---|---|
| DE | 10057069 | A1 | 5/2002 |
| DE | 102010052667 | A1 | 5/2012 |
| DE | 112011103634 | T5 | 8/2013 |
| EP | 1209057 | A1 | 5/2002 |
| EP | 2080647 | A2 | 7/2009 |
| GB | 2425290 | A | 10/2006 |
| JP | 2008154401 | A | 7/2008 |
| RU | 2294292 | C1 | 2/2007 |
| RU | 94928 | U1 | 6/2010 |

* cited by examiner

ASSEMBLY HAVING AN UNDERCARRIAGE UNIT

BACKGROUND OF THE INVENTION

Field of the Invention

The invention pertains to an assembly for a vehicle, especially a rail vehicle, which comprises an undercarriage unit with at least a first wheel set supported on a track and a main body supported on the first wheel set, having a coupling mechanism for mechanical coupling to at least one car body of the vehicle, at least a first driving motor, which is provided for driving the first wheel set, at least one power supply unit, which is provided to supply the driving motor with electric power, and at least one inverter unit.

Present-day drive systems of traction vehicles, especially electrically driven rail vehicles, traditionally have one or more driving motors, each driving a wheel set of an undercarriage unit across a transmission unit or directly across a coupling. The driving motors are usually energized by one or more pulse inverters of a power supply unit. These are designed to create a current, especially a rotary current for the driving motors.

BRIEF SUMMARY OF THE INVENTION

The problem which the invention proposes to solve is to provide an assembly of this kind in which the undercarriage unit can be expanded in regard to its functionalities.

For this, it is proposed that the power supply unit is at least partially arranged in a region of the undercarriage unit. In this way, an advantageous expansion of the functionalities of the undercarriage unit can be accomplished, by providing a place for the generating of electric power by means of at least one inverter unit.

By a "region of the undercarriage unit" is meant in particular a region which—looking in the vertical direction and relative to the track—is disposed at the level of the wheel set and—looking in a horizontal direction perpendicular to the direction of travel of the vehicle—is bounded by at least one part of the undercarriage unit, especially a part of the main body. This bounding can occur on one side or preferably on two sides. Regarding the arrangement in the vertical direction, the power supply unit is advisedly at least partly disposed at a level which is less than the maximum wheel height of the wheel set. Advisedly, at least a lowermost edge of the power supply unit is disposed at a level which is less than the maximum wheel height of the wheel set. Preferably, the power supply unit is predominantly, especially entirely disposed in a region whose maximum height is less than this wheel height or at most corresponds to it. Especially advantageously, the power supply unit can be disposed at least partly at the level of the rotational axis of the wheel set.

By an "at least partial disposition of the power supply unit at a level" is meant that at least one part of the power supply unit is disposed at this level.

By a "level" is meant in particular a level relative to the track, calculated from a contact site of the wheel set with the track in the vertical direction.

A direction which is oriented parallel or perpendicular to the track is called a "horizontal direction" or "vertical direction", respectively. A horizontal direction which is oriented perpendicular to the direction of travel of the vehicle is called the "transverse direction".

By the at least partial disposition of the power supply unit in a region of the undercarriage unit a free structural space can be created advantageously in the car body or beneath the car body outside of the undercarriage unit, which can be otherwise utilized. A free structural space in the car body can be used in particular for a seat assembly. Moreover, the achievable space saving is advantageous in particular for a double-deck vehicle. As compared to a disposition of the power supply unit in the ceiling region of the vehicle, an advantageous vertically downward displacement of the center of gravity of the vehicle can be achieved. Especially advantageously, the power supply unit is at least predominantly, preferably entirely disposed in a region of the undercarriage unit.

An especially compact construction can be achieved in regard to a disposition of the power supply unit and the driving motor when the driving motor is disposed in a region of the undercarriage unit. In this case, the region for the power supply unit and the region for the driving motor preferably adjoin each other directly. In this way, an installation site can be created for the power supply unit which is disposed in immediate proximity to the driving motor. This furthermore has the advantage that a drive train comprising the power supply unit, the driving motor, a wheel set shaft of the wheel set and a transmission unit coupled to the driving motor and the wheel set shaft can be disposed in regions of the undercarriage unit. Furthermore, short cable paths can be achieved for connecting the power supply unit to the driving motor. The transmission of drive energy from the car body to the undercarriage unit can moreover occur in the form of a d.c. voltage, which is typically provided by a so-called intermediate circuit. In another variant embodiment, the drive energy can come from the car body to the undercarriage unit in the form of a medium-frequency alternating voltage supply. An alternating current transmission designed in particular for a heavy current between the inverter unit and the driving motor can occur via an extremely short path at the level of the undercarriage unit. This can offer several advantages: reducing of the current load of the cable as compared to a solution with power supply unit arranged in or on the car body by typically 30 to 50%, reducing of the time mean value of the current load in light rail vehicles with a low proportion of operating scenarios with maximum traction power, economical and light design of the power cables. In particular, a direct flexible conduction connection can be accomplished between the driving motor and the inverter unit, since only slight relative movements can occur between these units—especially during rotational or swaying motion of the undercarriage unit.

The assembly advantageously has a mounting unit for the mounting of the power supply unit. The mounting unit can be a structural unit designed separate from the power supply unit, such as a mounting plate or a mounting frame, on which the power supply unit is mounted and which is secured to a further structural part. Alternatively or additionally, the mounting unit can be formed at least by one part of the power supply unit itself, e.g., a housing part, and then this part of the power supply unit is fastened directly to the further structural part.

Between the car body and the undercarriage unit on which it is supported there is traditionally installed a single or usually multiple-stage suspension, so that the car body is subjected to distinctly lower impact accelerations and continual vibrations than the undercarriage unit. Thus—for a traditional arrangement of the power supply unit in the car body—the components of the power supply unit which are typically formed from sensitive semiconductor components, are subjected to attenuated mechanical stresses.

For the protection of the power supply unit, in one preferred embodiment of the invention it is proposed that the assembly has a suspension unit by which at least one component of the power supply unit is sprung at least against the first wheel set. The component is preferably parts of a power electronics system, especially semiconductor switching elements, which can be protected against impacts and strong accelerations. The cushioning which can be achieved by the suspension unit can be a cushioning in the direction of travel of the vehicle, in the transverse direction, and/or in the vertical direction.

In one advantageous embodiment of the invention, it is proposed that the suspension unit has a spring device by which the mounting unit is sprung against the main body. In this way, the mounting unit and the components mounted by means of it, especially the power supply unit, can be at least partly decoupled from the main body. This decoupling occurs expediently in the direction of travel of the vehicle, in a horizontal transverse direction perpendicular thereto, and/or in the vertical direction. Thanks to this at least partial decoupling of the mounting unit from the main body, impact accelerations of the mounting unit with respect to the other parts of the undercarriage unit can be substantially reduced. In particular, these impact accelerations can be kept below a critical limit value for the inverter unit of around 5 g. This value is due in particular to the typical design of the inverter unit with a sensitive power electronics system, especially with semiconductor switching elements. The at least partial decoupling furthermore offers the advantage of a reduction of vibrations which may occur in the vertical and transverse direction. Thanks to the proposed sprung connection of the mounting unit—and therefore the power supply unit—to the main body via the spring device, an advantageous stabilization of the undercarriage unit can furthermore be achieved.

The spring device preferably connects one or more segments of the mounting unit to one or more segments of the main body. For this, the spring device has one or more spring elements, which are disposed in a region of the undercarriage unit.

If the main body itself is sprung against the wheel set, a two-stage cushioning of the power supply unit against the wheel set can be achieved. The cushioning of the main body against the wheel set—also known as a "primary cushioning"—forms together with the proposed spring device a design of the suspension unit whereby the power supply unit is especially efficiently sprung against the first wheel set.

Especially advantageously, the spring device and the power supply unit form parts of a vibration absorber unit. This serves advisedly to limit vibration amplitudes of the main body in a particular critical frequency range. The masses attuned to this limiting are advantageously at least formed by the power supply unit in combination with further components which are advisedly mounted on the mounting unit.

In one advantageous modification of the invention it is proposed that the first driving motor is mounted on the mounting unit. In this way, a structurally simple design of the assembly can be achieved. In particular, the driving motor and the power supply unit can be mounted on a common device carrier formed by the mounting unit. Preferably, this device carrier is configured as a continuous, especially a single-piece part. If the mounting unit is sprung against the main body by means of the spring device, this spring device can additionally provide an at least partial decoupling of the driving motor from the main body. The driving motor and the power supply unit can together be at least partly decoupled from the main body by means of the spring device.

If the assembly is formed with at least one second driving motor, this can advantageously be mounted on the mounting unit.

Thanks to a mounting of the first and/or second driving motor and the power supply unit on the mounting unit—if the latter is sprung by means of the spring device against the main body—a formation serving as a vibration absorber unit can be provided, the parts of which are at least the spring device, the mounting unit, the power supply unit and the first and/or second driving motor. In this way, drive train components can serve as absorber masses in a structurally simple manner. As a result, a large absorber mass in total can be achieved, so that an especially efficient dampening of vibrations of the main body and thus an improved running of the undercarriage unit can result. These improvements can be achieved without increasing the overall vehicle mass, since one can avoid the use of additional masses, not present in traditional vehicles, for the stabilization of the undercarriage unit.

Furthermore, a rotating mass can be used especially advantageously as an absorber mass by means of the first and/or second driving motor.

In another embodiment of the invention, it is proposed that the mounting unit is carried by the main body. By this is meant in particular that the weight of the mounting unit and the components mounted on it is transmitted to the main body. This can advantageously result in a greater stability of the undercarriage unit, especially due to increased inertia.

For example, the mounting unit can be hung from the main body. An advantageous combination of a supporting and a cushioning function can be achieved if the mounting unit is hung by means of the spring device from the main body.

In an alternative embodiment, it is proposed that the assembly has at least one car body of the vehicle, wherein the mounting unit is supported by the car body. In this way, one can achieve an at least two-stage cushioning of the power supply unit against the wheel set. The cushioning of the main body against the wheel set—also known as "primary cushioning"—and a cushioning of the car body against the main body—also known as "secondary cushioning"—together form a design of the suspension unit by which the power supply unit is especially efficiently sprung against the first wheel set.

Moreover, it is proposed that the power supply unit—at least looking in the direction of travel of the vehicle—is disposed at least partly in a middle region of the undercarriage unit. Thanks to this middle disposition of the power supply unit relative to the undercarriage unit, an advantageous run of cable connections—vertical if possible—between the power supply unit and the car body can be achieved. Furthermore, a good protection of these cable connections, especially against stones thrown up from the track bed, can be achieved. If the undercarriage unit is designed with a pivot, the middle region directly encloses the pivot.

If the power supply unit is movable relative to the car body—for example, being mechanically coupled by means of the mounting unit to the main body—relative movements to the car body will occur in the middle region of the undercarriage unit, which are limited and therefore easy to compensate for. A structural space in the middle region of the undercarriage unit can be easily utilized for the at least partial arrangement of the power supply unit if the driving motor and the wheel set are installed coaxially to each other, the motor axle advisedly corresponding to the rotational axis of the wheel set.

In this case, no transmission unit is needed for the drive coupling of the driving motor to the wheel set.

If the undercarriage unit has at least a second wheel set, supported on the track, it is proposed that the power supply unit—in the direction of travel of the vehicle—is arranged between the wheel sets. In particular, a structural space in the middle region of the undercarriage unit can be easily utilized for the at least partial arrangement of the power supply unit when this second wheel set is configured as an idler wheel set—i.e., a nondriven wheel set.

Furthermore, it is proposed that the main body has a pair of parallel longitudinal beams pointing in the direction of travel of the vehicle and the power supply unit—in the transverse direction—is arranged at least partly between the longitudinal beams. In this way, a middle arrangement of the power supply unit in the undercarriage unit relative to the transverse direction can be achieved, so that in particular an advantageous protection of the power supply unit can be achieved.

In one advantageous modification of the invention it is proposed that the assembly has two car bodies of the vehicle, which are supported on the undercarriage unit. In particular, the undercarriage unit can be configured in this case as a so-called "Jakob bogie".

In another advantageous embodiment of the invention it is proposed that the assembly has at least one brake device, which is coordinated with the undercarriage unit, and a control unit provided to control the brake device, which is arranged at least partly in a region of the undercarriage unit. In this case, short control lines from the brake control system to the brake elements can be achieved.

Moreover, it is proposed that the assembly has a sensor unit, which serves to detect at least one characteristic quantity of the undercarriage unit, and an evaluation unit for evaluating the characteristic quantity, which is at least partly arranged in a region of the undercarriage unit. In this way, short lines can be achieved between the elements of the sensor unit and the evaluation unit. By a "characteristic quantity of the undercarriage unit" is meant a characteristic quantity which characterizes the running properties of the undercarriage unit. The characteristic quantity can be a temperature, velocity, acceleration, vibration characteristic quantity and so forth.

Advisedly, the control unit and/or the evaluation unit is at least partly a component of the power supply unit, so that structural space and structural parts can be economized.

BRIEF DESCRIPTION OF THE SEVERAL VIEWS OF THE DRAWINGS

Example embodiments of the invention shall be explained by means of the drawings. There are shown.

DESCRIPTION OF THE INVENTION

Figure 1:
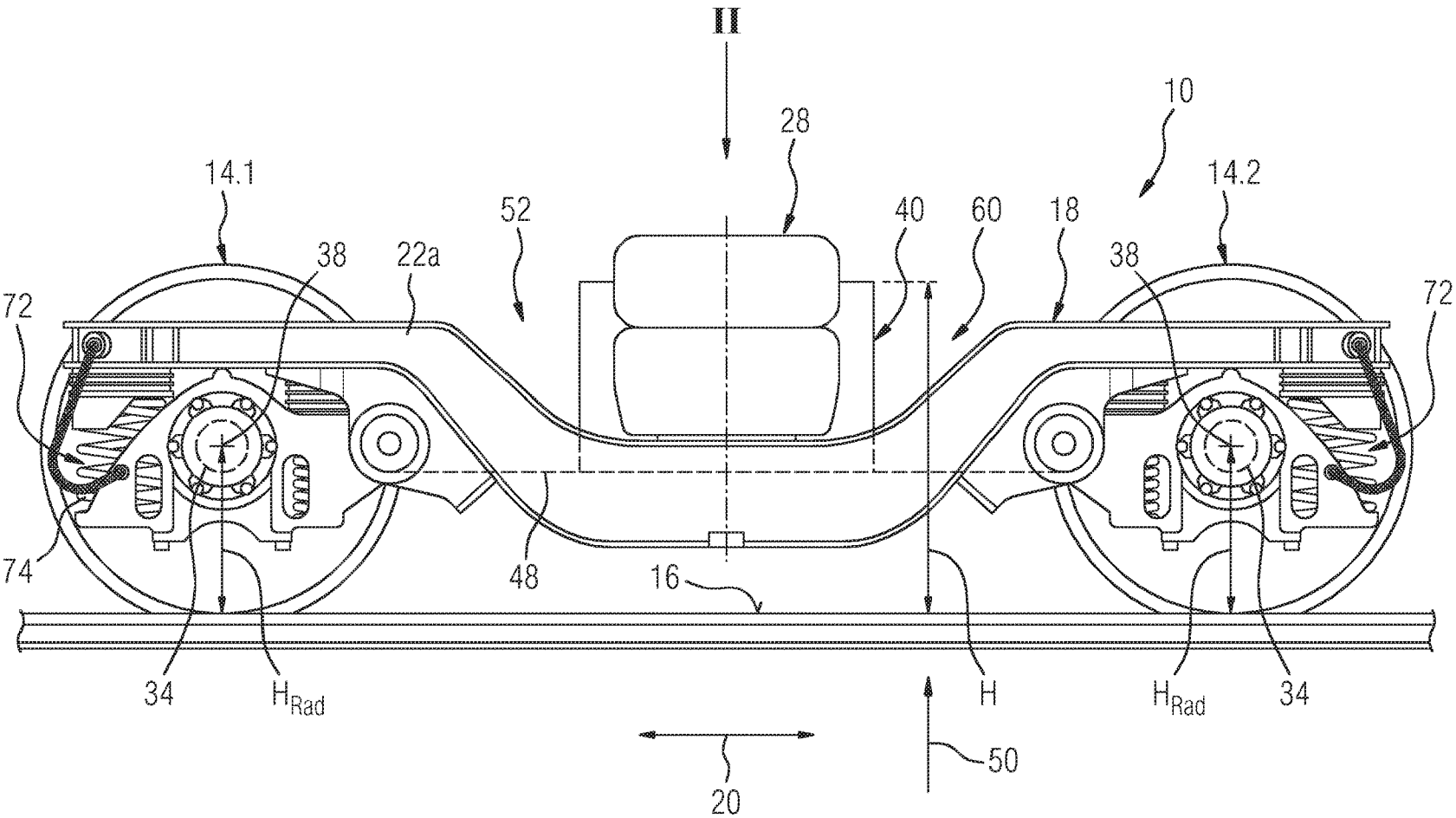
FIG. 1: an assembly with an undercarriage unit in a side view.
Figure 2:
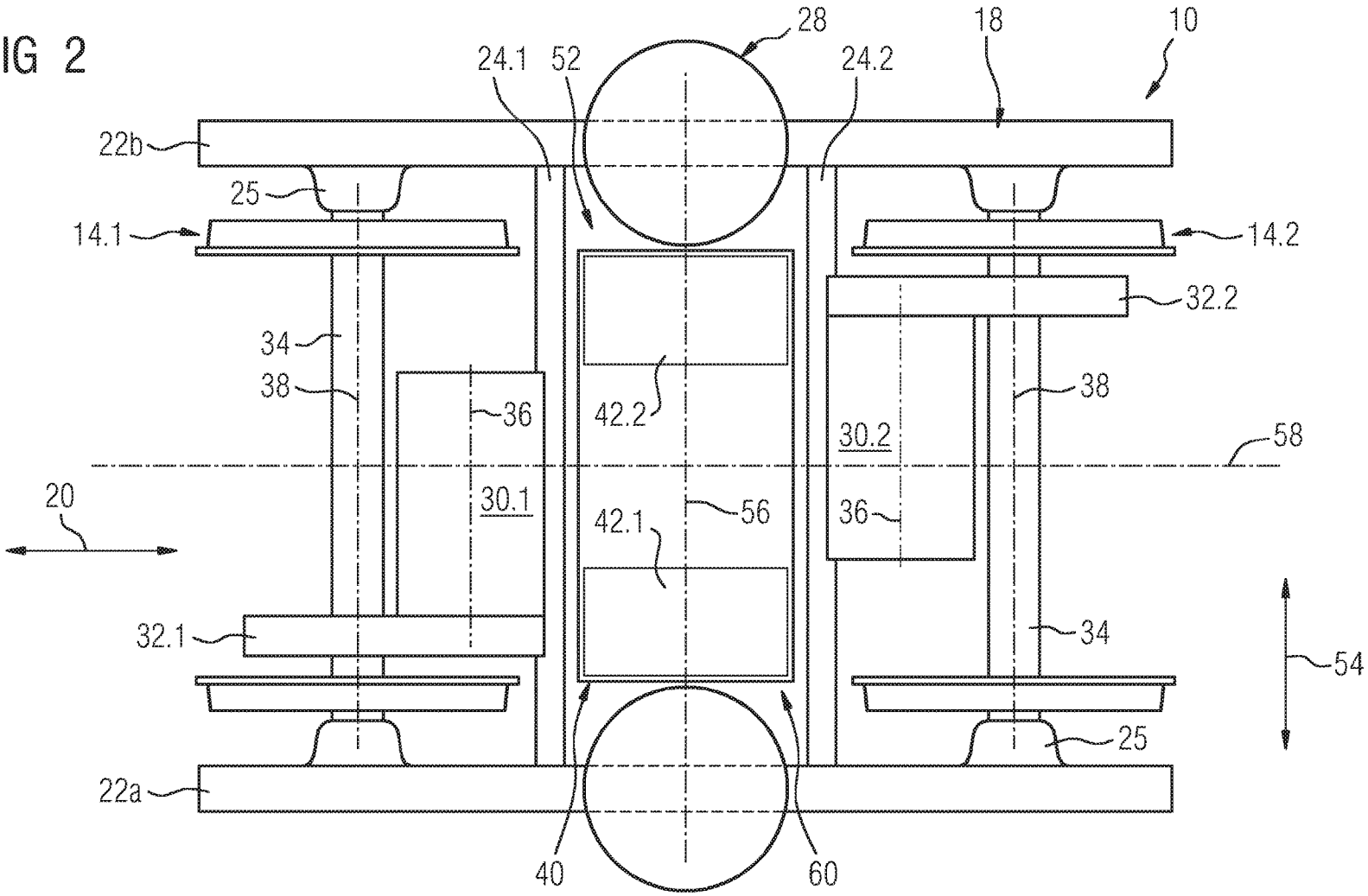
FIG. 2: the assembly of FIG. 1 in a top view from above.
Figure 5:
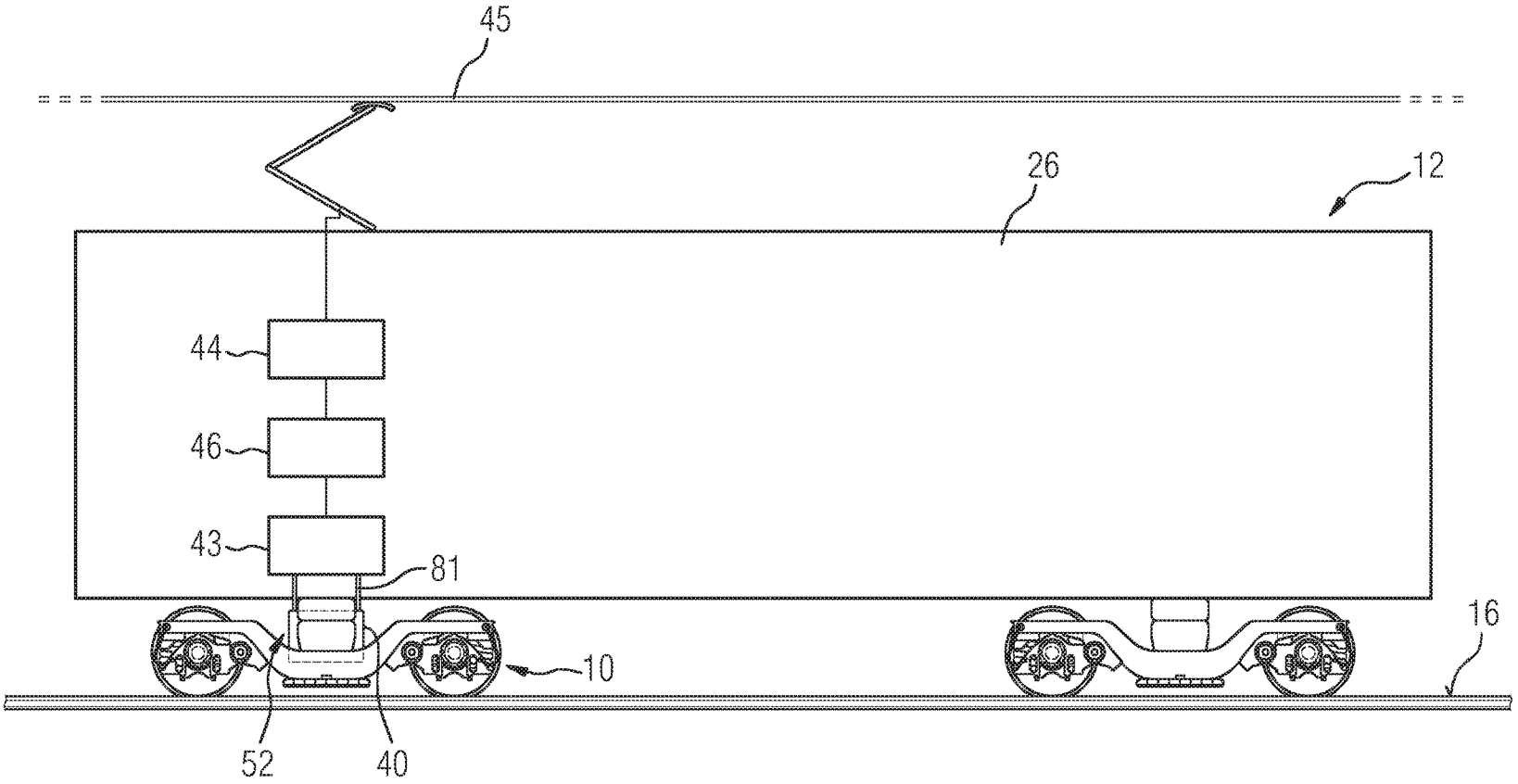

FIG. 1 shows an assembly with an undercarriage unit 10 for a rail vehicle 12 shown in FIG. 5 in a side view. The assembly is shown in FIG. 2 in a top view from above.

The undercarriage unit 10 in the example embodiment being considered is configured as a bogie unit, having two wheel sets 14.1, 14.2. The wheel sets 14 are supported on a track 16, formed by rails. The undercarriage unit 10 moreover has a main body 18, which is supported on the wheel sets 14. The main body 18 is known in technical parlance as an "undercarriage frame" and has two parallel longitudinal beams 22*a*, 22*b* extending in the direction of travel 20 of the rail vehicle 12, which are joined together by two horizontal transverse beams 24.1, 24.2 oriented perpendicular to the direction of travel 20. The mounting of the wheel sets 14 on the main body 18 is done by means of wheel set bearings 25.

During the manufacture of the rail vehicle 12, the undercarriage unit 10 is mechanically coupled to a car body 26 of the rail vehicle 12. For this, the undercarriage unit 10 has a coupling mechanism 28, which as explained in more detail further below comprises gas pressure springs, especially air springs.

The undercarriage unit 10 is moreover configured as a driven undercarriage unit, especially as a driven bogie unit. The assembly in this case has two driving motors 30.1, 30.2, each being provided to drive one of the wheel sets 14.1 or 14.2. The driving motors 30.1, 30.2 can be seen in FIG. 2. In the configuration shown, the driving motors 30 are arranged each time at the side next to the wheel set shaft 34 of the coordinated wheel set 14 and are drive-coupled to the coordinated wheel set 14.1 or 14.2 by means of a transmission unit 32.1 or 32.2. The driving motors 30 each have a motor axle 36, which is arranged at the side next to the wheel set shaft 34 and oriented parallel to the rotational axis 38 of the corresponding wheel set 14.

In a further variant embodiment, at least one of the driving motors 30 can comprise the wheel set shaft 34, while the motor axle 36 coincides with the rotational axis 38 of the corresponding wheel set 14. In general, the drive coupling of the driving motors 30 to the respective wheel set shaft 34 can occur by means of a coupling mechanism, alternatively to a transmission unit.

For the supplying of electric power to the driving motors 30, the assembly is provided with a power supply unit 40. This has two inverter units 42.1, 42.2, each of which is coordinated with one driving motor 30.1 or 30.2 and they are designed to generate an alternating electric current for the coordinated driving motor 30.1 or 30.2 from a provided d.c. voltage. This d.c. voltage is in particular a voltage provided in a so-called intermediate circuit 43, which is supplied either directly from a train network supply conducting a d.c. voltage or from a voltage transformer unit which serves to transform an alternating voltage provided by a train network supply 45. For this, the voltage transformer unit has at least one transformer 44 and one rectifier unit 46, which are arranged in a car body 26 of the rail vehicle 12 (see FIG. 5). The representation of the voltage transformer unit and the intermediate circuit 43 and their arrangement in the car body 26 per FIG. 5 are highly schematic.

In the embodiment under review, the driving motors 30 are each time designed as asynchronous machines, especially as rotary current asynchronous machines. In one variant of the embodiment in question with two inverter units 42, rotary current synchronous machines can be provided. The inverter units 42 are each time designed as pulse inverters, which generate the current needed by the respective driving motor 30, especially rotary current, according to a driving torque which is to be generated. They have switching elements in familiar manner, which are designed in particular as semiconductor components.

In particular, these switching elements are designed as IGBT ("Insulated Gate Bipolar Transistors"). In an alternative embodiment, it is conceivable that both driving motors 30 can be energized by a common inverter unit 42.

Figure 3:
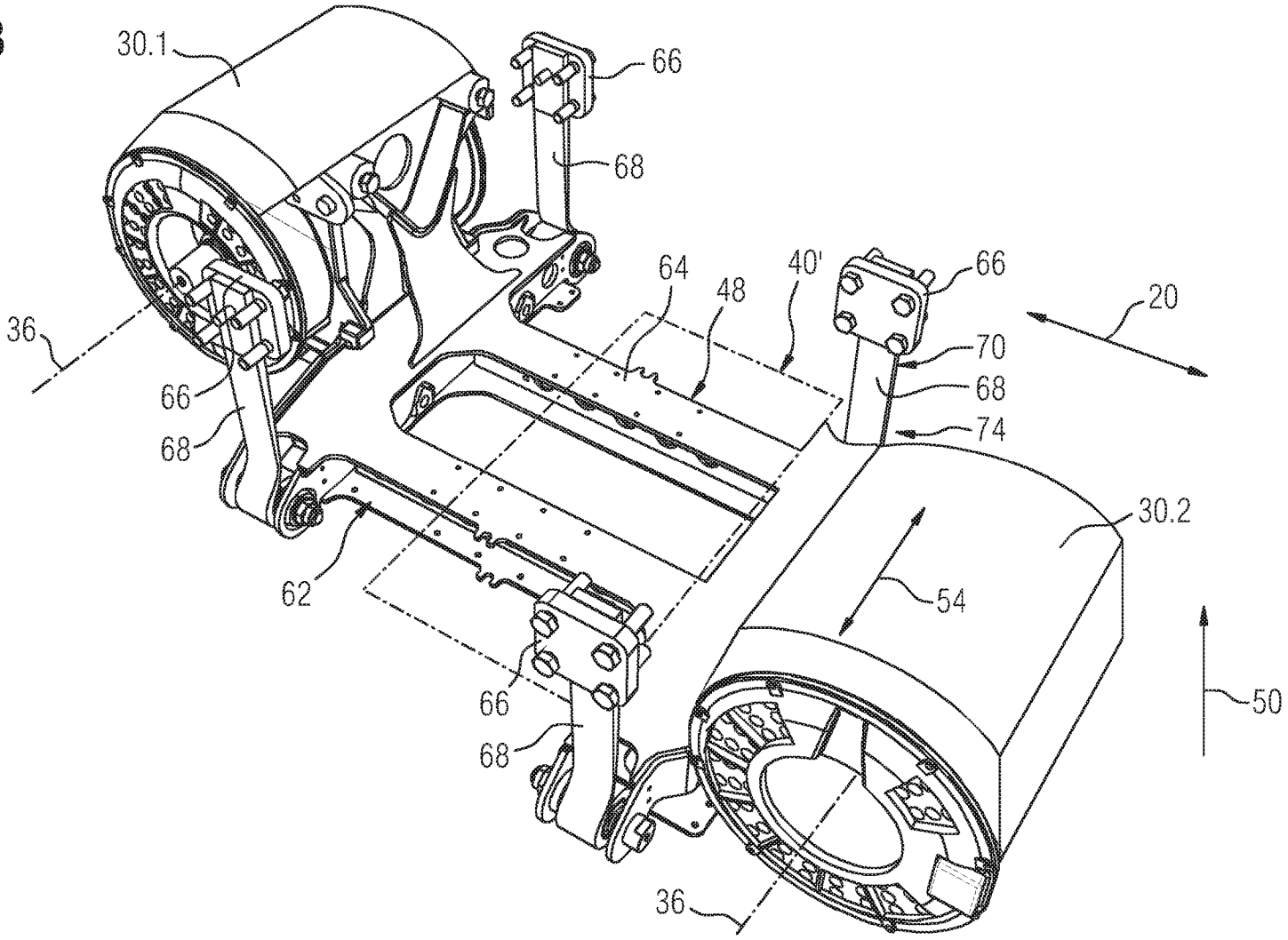
FIG. 3: a mounting unit arranged on the undercarriage unit, in a perspective view.

The assembly moreover has a mounting unit 48, on which the power supply unit 40 is mounted. This can be seen in FIGS. 1 and 3. FIG. 3 shows the mounting unit 48, the installation site 40' provided for the power supply unit 40 and the driving motors 30 in a perspective view. For sake of clarity, a complete representation of the power supply unit 40 is not shown in FIG. 3.

As can be seen especially in FIGS. 1 and 2, the power supply unit 40 is arranged in a region 52 of the undercarriage unit 10. The arrangement of the power supply unit 40 in the example embodiment in question shall be explained more closely below for each spatial direction.

In regard to the arrangement of the power supply unit 40 in the vertical direction 50, this is arranged at least partly at the level of the wheel set shafts 34 (see FIG. 1). By this is meant that at least a part of the power supply unit 40 is arranged at this level. This level, designated in FIG. 1 as "$H_{Rad}$", corresponds to the level of the rotational axis 38 relative to the track 16.

From FIG. 3 one can infer about the level of the power supply unit 40 the fact that this is situated at the level of the driving motors 30. In particular, at least a part of the power supply unit 40 is arranged at the level of the motor axles 36.

The arrangement of the power supply unit 40—continuing to look in the vertical direction 50—can furthermore be characterized in that it is arranged at least partly at the level of the main body 18 of the undercarriage unit 10. Otherwise put, the region 52 in which the power supply unit 40 is arranged—looking in the transverse direction 54, that is, in the lengthwise direction of the wheel set shafts 34—is bordered at least by a part of the main body 18, in particular, by a longitudinal beam 22.

The uppermost end of the power supply unit 40 furthermore has a height H in the vertical direction 50 relative to the track 16 which is less than the maximum wheel height of the wheel sets 14 and at most corresponds to this. In the coupled state of the undercarriage unit 10 with the car body 26, therefore, the power supply unit 40 is situated between the car body 26 and the track 16—still looking in the vertical direction 50.

Regarding the arrangement of the power supply unit 40 in the direction of travel 20, this is characterized in that the power supply unit 40 is arranged between the wheel sets 14.1, 14.2. The power supply unit 40 is therefore disposed in a middle region 60 of the undercarriage unit 10—looking in the direction of travel 20. In particular, the power supply unit 40 lies on the center axis 56 of the undercarriage unit 10, oriented in the transverse direction 54.

Furthermore, from FIGS. 2 and 3 one can see the feature that the power supply unit 40 is disposed between the driving motors 30—again looking in the direction of travel 20.

Regarding the arrangement of the power supply unit 40 in the transverse direction 54, it is disposed between the longitudinal beams 22*a*, 22*b* (see FIG. 2). The inverter units 42.1, 42.2 are disposed on both sides of the center axis 58 of the undercarriage unit 10, oriented in the direction of travel 20. This is especially suitable for a design of the undercarriage unit 10 with a central pivot (not shown).

The mounting unit 48, which is shown in detail in FIG. 3, has a mounting frame 62. The driving motors 30 are firmly supported at both ends of the mounting frame 62—looking in the direction of travel 20. Between these ends there is a middle region of the mounting frame 62, having in particular two parallel longitudinal beams 64, on which the power supply unit 40 is arranged and secured. In place of these longitudinal beams 64, a support plate could be provided.

The mounting unit 48 is mounted on the main body 18 in the embodiment being considered. For this, fastening units 66 are provided, which are fastened on the main body 18 or on a part rigidly joined to the main body 18. The mounting unit 48 is joined by connection elements 68 to the fastening units 66. These connection elements 68 extend from the respective fastening unit 66 vertically downward, so that the mounting unit 48 is in a suspended position with regard to the main body 18. In other words, the mounting unit 48 is hung by means of the fastening units 66 and the vertical connection elements 68 from the main body 18. The weight of the mounting unit 48 and the components mounted on it is transmitted by the connection elements 68 and the fastening units 66 to the main body 18, which then has the function of a supporting body for the mounting unit 48 and the corresponding components.

During maintenance or in order to replace components of the drive train, the mounting unit 48 can be loosened from the main body 18 and dismantled from the undercarriage unit 10 at the bottom.

In the embodiment being considered, the power supply unit 40 is sprung as follows against the wheel sets 14. For the suspension, the assembly has a spring device 70 by which the mounting unit 48 is sprung against the main body 18. The spring device 70 has connection elements 68 for this, each in the form of a spring. In the embodiment being considered, these are configured as leaf springs. The connection elements 68 serve to a least partly decouple the mounting unit 48—and therefore the power supply unit 40 and the driving motors 30—from the main body 18. This decoupling occurs essentially in the transverse direction 54 in the embodiment in question. In other embodiments adapted to particular needs, the connection elements 68 can be designed to provide a suspension essentially in the vertical direction 50, and the spring device 70 as needed can have spring elements which are designed to suspend the mounting unit 48 in the transverse direction 54 and/or in the direction of travel 20. The main body 18 itself is sprung by a primary spring unit 72 against the wheel sets 14 (see FIG. 1). The spring device 70 and the primary spring unit 72 accordingly form a suspension unit 74 by which the mounting unit 48 and therefore in particular the power supply unit 40 are sprung against the wheel sets 14. The spring device 70 forms a connection between the main body 18 and the mounting unit 48 which is different from the secondary spring unit.

The mounting unit 48, the components mounted on it—especially power supply unit 40 and driving motors 30—and the spring device 70 form a vibration absorber unit in regard to vibrations of the undercarriage unit 10. The absorber masses here are formed essentially by the driving motors 30 and the power supply unit 40. If need be, additional masses can be provided, which are rigidly coupled with the mounting unit 48. The vibration absorber unit has rotating absorber masses, each of them formed by the driving motors 30.

Figure 4:
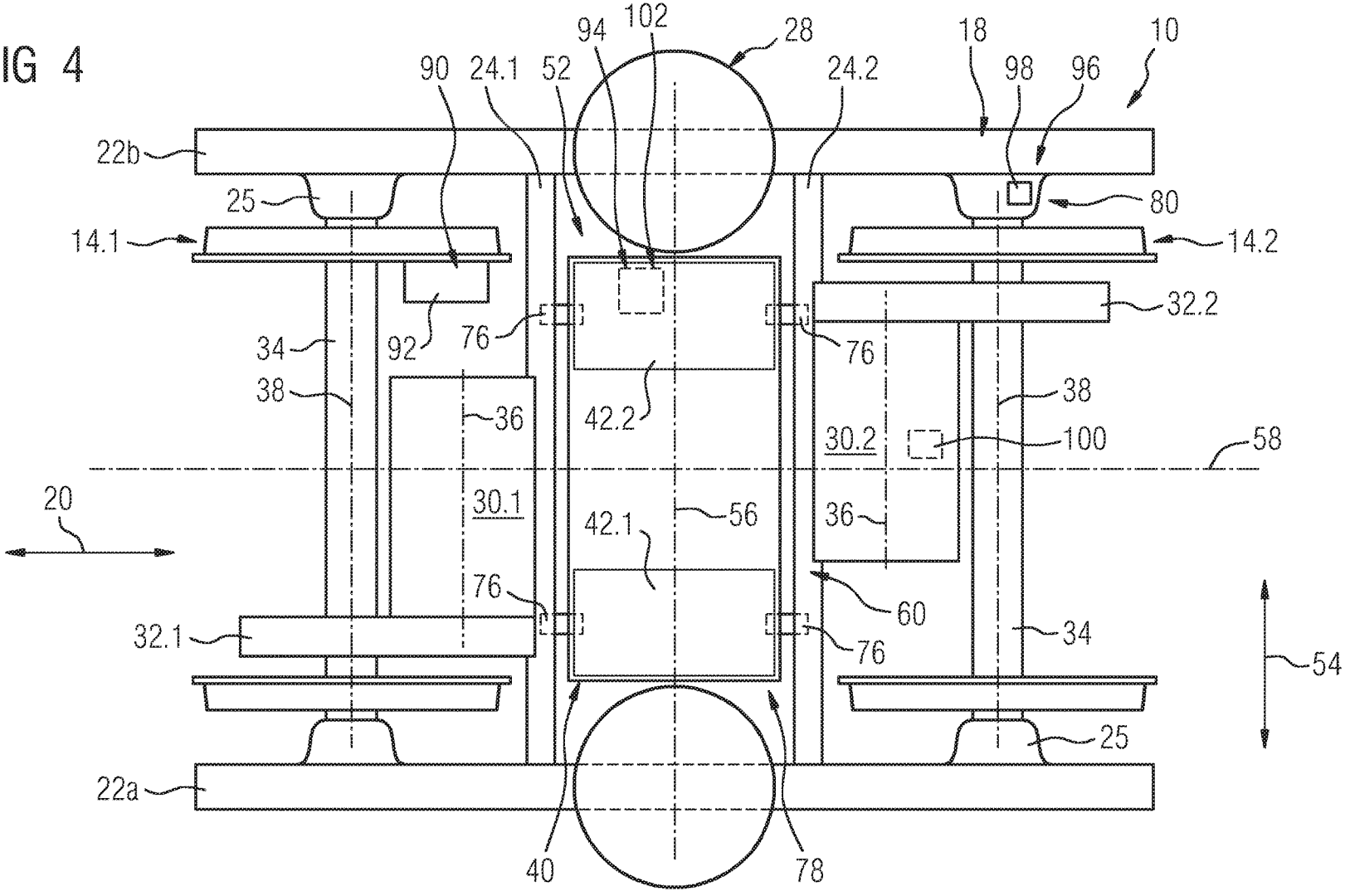
FIG. 4: an alternative configuration of the assembly of FIG. 2, FIG. 5: the assembly from FIG. 1 or FIG. 4 and a car body.

Another example embodiment is shown in FIG. 4. This corresponds basically to the representation of FIG. 2, and the following text will be confined to the differences from the embodiment of FIGS. 1 to 3. Furthermore, the reference numbers of the above described embodiment shall be retained.

The embodiment per FIG. 4 differs from the previous embodiment in that the power supply unit 40 is rigidly joined to the main body 18. For example, this can occur by means of fastening elements 76, by which a mounting unit 78 is fastened to the transverse beams 24.1, 24.2. The mounting unit 78 in the embodiment being considered is formed by a housing unit of the power supply unit 40, for example, by housing of the inverter units 42. Alternatively or additionally, a mounting unit can be provided which is separate from the power supply unit 40, on which the power supply unit 40 is rigidly mounted and which is secured to the main body 18, in particular, to the transverse beams 24. In this embodiment, the power supply unit 40 is sprung by the primary spring unit 72 against the wheel sets 14. Therefore, it forms a suspension unit 80 by which the power supply unit 80 is sprung against the wheel sets 14.

FIG. 5 shows the rail vehicle 12 with a car body 26, which is supported by means of the undercarriage unit 10 on the track 16. The undercarriage unit 10 here can be designed in the embodiment of FIGS. 1 to 3 or in the embodiment of FIG. 4. The connection between the intermediate circuit 43 and the power supply unit 40 occurs by means of cable connections 81, carrying a d.c. voltage. A cable path by which an alternating current generated by the power supply unit 40 is taken to the driving motors 30 is present only inside the undercarriage unit 10 and accordingly is short in its layout. Besides the cable connections 81, a water cooling line and/or control lines (not shown) can also run from the car body 26 to the undercarriage unit 10.

Figure 6:
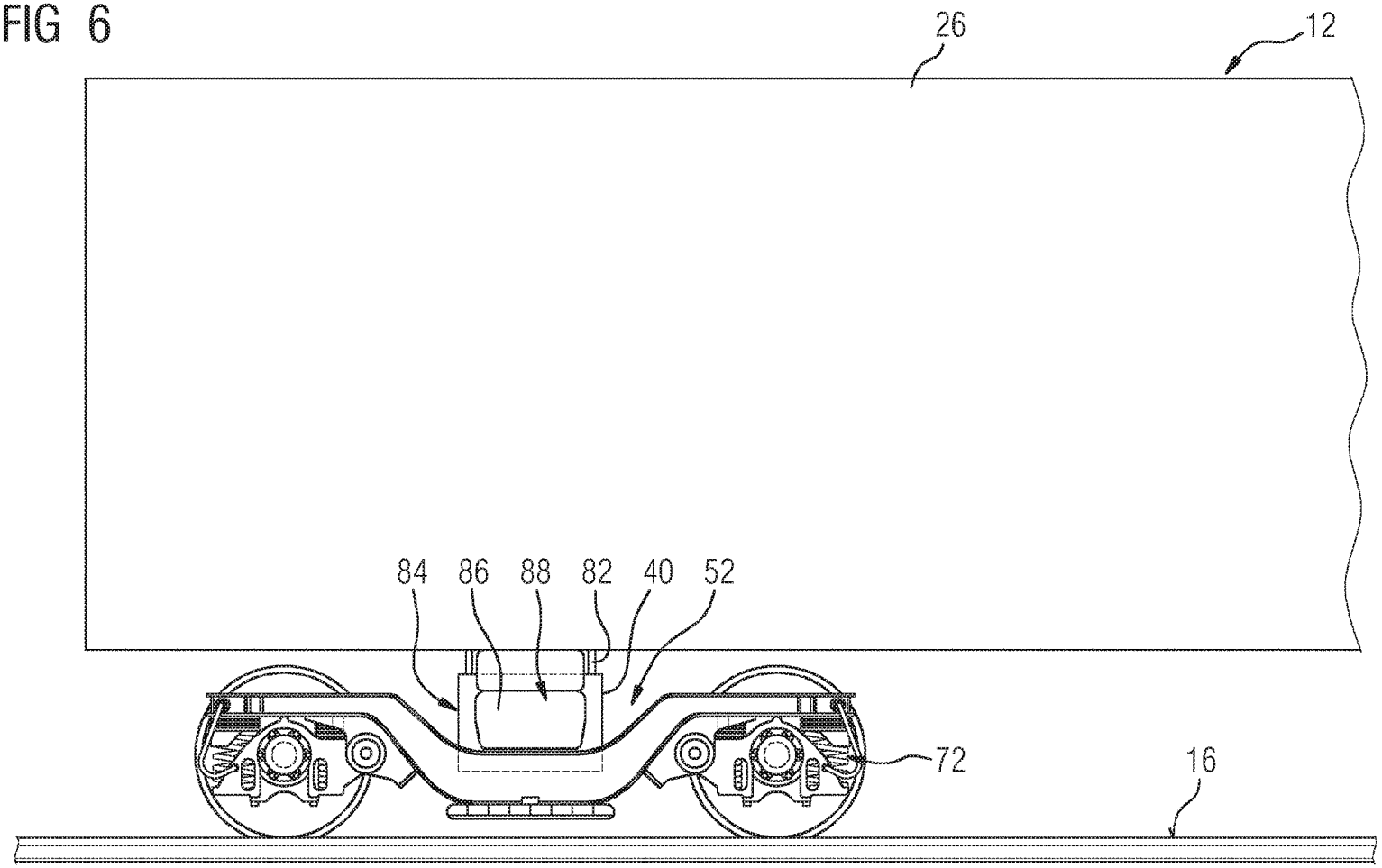
FIG. 6: an alternative connection of the assembly to the car body.

FIG. 6 shows another example embodiment of the invention. This figure shows the car body 26 and the undercarriage unit 10 coupled to it. The following text is confined to the differences from the embodiments per FIGS. 1 to 3 and per FIG. 4. Furthermore, the reference numbers of the above described embodiments are retained. The embodiment of FIG. 6 differs in that the power supply unit 40 is supported by the car body 26. For example, this can be done by means of fastening elements 82 by which a mounting unit 84 is fastened to the car body 26. The mounting unit 84 in the embodiment being considered is formed by a housing unit of the power supply unit 40, for example, by housings of the inverter units 42. Alternatively or additionally, a mounting unit can be provided which is separate from the power supply unit 40, on which the power supply unit 40 is rigidly mounted and which is secured to the car body 26. The fastening elements 82 extend from a coupling point on the car body 26 vertically downward, so that the mounting unit 84 is in a suspended position with regard to the car body 26. In other words, the mounting unit 84 is hung by means of the fastening elements 82 from the car body 26. The weight of the mounting unit 84 and the components mounted on it is transmitted by means of the fastening elements 82 to the car body 26. Regarding the position of the power supply unit 40 relative to the undercarriage unit 10, refer to the above remarks.

In this embodiment, the power supply unit 40 is sprung by means of the primary spring unit 72 and by means of a secondary spring unit 86 against the wheel sets 14. The secondary spring unit 86 has the function of cushioning the car body 26 against the main body 18 of the undercarriage unit 10. It has gas pressure springs, especially air springs, which as described above are part of the coupling mechanism 28. The primary spring unit 72 and the secondary spring unit 86 form a suspension unit 88 by which the power supply unit 40 is sprung against the wheel sets 14. The suspension unit 88 can additionally have a further spring device which cushions the mounting unit 84 against the car body 26.

Figure 7:
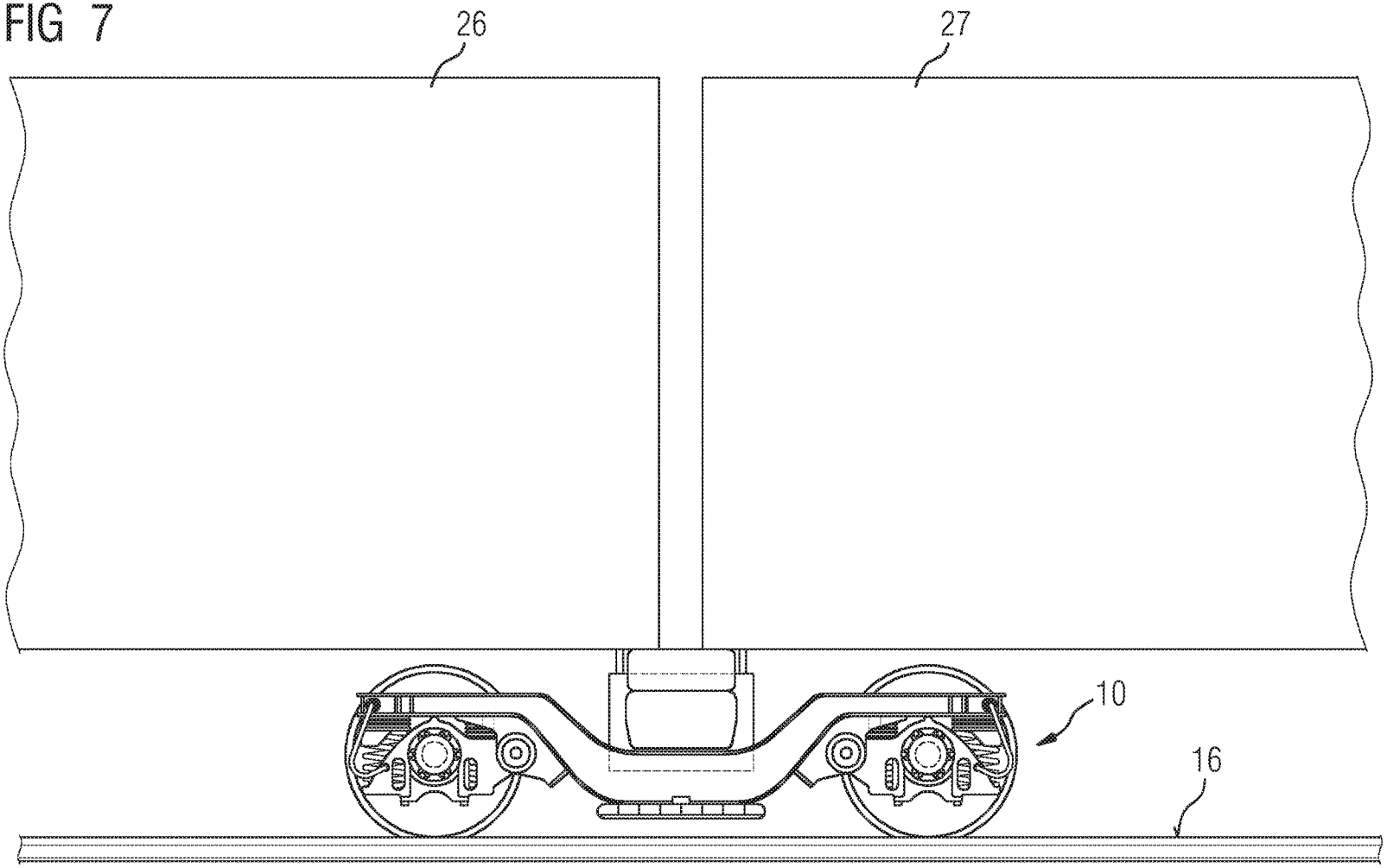
FIG. 7: a configuration of the assembly with a Jakob bogie.

FIG. 7 shows another example embodiment of the invention. The following text is confined to the differences from the embodiments per FIGS. 1 to 6. Furthermore, the reference numbers of the above described embodiments are retained. The embodiment of FIG. 7 differs in that two car bodies 26 and 27 are supported on the undercarriage unit 10. The undercarriage unit 10 in this embodiment is configured as a Jakob bogie.

Brake control and sensor aspects of the invention shall be described in regard to FIG. 4.

The assembly has a brake device 90 coordinated with the undercarriage unit 10, which on the one hand is formed by a mechanical brake unit 92 coupled to the wheel sets 14.1, 14.2 and on the other hand by the driving motors 30.1, 30.2. For sake of clarity, only one brake element of the mechanical brake unit 92 is shown in FIG. 2. For the control of the brake device 90, there is provided a control unit 94, which is disposed in the region 52 of the undercarriage unit 10. This control unit 94 is designed in particular as part of the power supply unit 40. The control unit 94 can be formed by a control device which serves to control at least one inverter unit 42.

Furthermore, the assembly has a sensor unit 96, which serves to detect at least one characteristic quantity of the undercarriage unit 10. The figure shows as an example a temperature sensor 98 and a revolution counter 100, although other sensors could be provided. To evaluate the characteristic quantities detected by the sensor unit 96, an evaluation unit 102 is provided, being arranged in the region 52 of the undercarriage unit 10. In particular, the evaluation unit 102 is designed as part of the power supply unit 40. For example, the evaluation unit 102 can be formed by the control unit 94, as shown in the drawing.

Moreover, connections (not shown) are provided by which the brake device 90 and the sensor unit 96 are connected to the coordinated control unit 94 and evaluation unit 102. In the embodiment being considered, these connections occur between the brake device 90 and the sensor unit 96 and the supply unit 40 and can occur over especially short pathways.

The brake control and sensor aspects of the invention explained above on the basis of FIG. 4 can likewise be used in the embodiment per FIG. 2.

The invention claimed is:

1. An assembly for a vehicle or a rail vehicle, the assembly comprising:

an undercarriage unit having at least one first wheel set to be supported on a track, a main body supported on said at least one first wheel set, and a coupling mechanism for mechanical coupling to at least one car body of the vehicle;

at least one first driving motor for driving said at least one first wheel set; and at least one power supply unit for supplying said at least one first driving motor with electric power, and at least one inverter unit, said at least one power supply unit having at least one component disposed in a region of said undercarriage unit;

a mounting unit for mounting said at least one component;

a suspension unit, said at least one component being sprung at least against said at least one first wheel set by said suspension unit, said suspension unit having a spring device, said mounting unit being sprung against said main body by said spring device.

2. The assembly according to claim 1, wherein said spring device and said at least one power supply unit form parts of a vibration absorber unit.

3. The assembly according to claim 1, wherein said at least one first driving motor is mounted on said mounting unit.

4. The assembly according to claim 1, wherein said mounting unit is carried by said main body.

5. The assembly according to claim 1, wherein said mounting unit is hung from said main body by said spring device.

6. The assembly according to claim 1, wherein said mounting unit is supported by the at least one car body of the vehicle.

7. The assembly according to claim 1, wherein said undercarriage unit has a middle region disposed along a direction of travel of the vehicle, and said at least one power supply unit is disposed at least partly in said middle region.

8. The assembly according to claim 1, wherein said undercarriage unit supports two car bodies of the vehicle.

9. The assembly according to claim 1, which further comprises:

at least one brake device coordinated with said undercarriage unit; and a control unit disposed at least partly in a region of said undercarriage unit for controlling said at least one brake device.

10. The assembly according to claim 1, which further comprises:

a sensor unit for detecting at least one characteristic quantity of said undercarriage unit; and an evaluation unit at least partly disposed in a region of said undercarriage unit for evaluating said characteristic quantity.

11. The assembly according to claim 9, which further comprises:

a sensor unit for detecting at least one characteristic quantity of said undercarriage unit; and an evaluation unit at least partly disposed in said region of said undercarriage unit for evaluating said characteristic quantity;

at least one of said control unit or said evaluation unit being at least partly a component of said at least one power supply unit.

12. A rail vehicle, comprising:

a first car body; and an assembly according to claim 1.

* * * * *